US008657623B2

(12) United States Patent
Heebe et al.

(10) Patent No.: US 8,657,623 B2
(45) Date of Patent: Feb. 25, 2014

(54) CONNECT/DISCONNECT CONNECTOR FOR COAXIAL CABLE

(76) Inventors: Clarke Heebe, Mandeville, LA (US); Melvin L. Arroyo, Gretna, LA (US)

( * ) Notice: Subject to any disclaimer, the term of this patent is extended or adjusted under 35 U.S.C. 154(b) by 0 days.

(21) Appl. No.: 13/374,154

(22) Filed: Dec. 14, 2011

(65) Prior Publication Data

US 2013/0157487 A1 Jun. 20, 2013

(51) Int. Cl.
*H01R 9/05* (2006.01)

(52) U.S. Cl.
USPC ..... 439/578; 439/348

(58) Field of Classification Search
USPC ..... 439/348, 578
See application file for complete search history.

(56) References Cited

U.S. PATENT DOCUMENTS 3,032,359 A * 5/1962 Cator ..... 285/277
3,858,156 A 12/1974 Zarro
6,655,991 B2 * 12/2003 Heebe et al. ..... 439/578
6,716,048 B2 * 4/2004 Collin et al. ..... 439/317
6,761,588 B2 * 7/2004 Heebe et al. ..... 439/578
7,331,813 B2 * 2/2008 Tsujita ..... 439/348
2003/0129873 A1 * 7/2003 Heebe et al. ..... 439/578
2004/0067675 A1 * 4/2004 Heebe et al. ..... 439/348
2004/0106320 A1 * 6/2004 Collin et al. ..... 439/348

* cited by examiner

*Primary Examiner* — Ross Gushi
(74) *Attorney, Agent, or Firm* — Keaty Law Firm LLC

(57) ABSTRACT

A connector for quick connect/disconnect engagement between two or more segments of coaxial cable has a hollow housing for attaching to a first electrical conductor and a coupler for attaching to a second electrical conductor. The housing and the coupler move to a limited distance in a sliding relation to each other. A locking member is fitted between the housing and the coupler to lock position of the housing in relation to the coupler and disengage the housing from the coupler when needed. The locking member has a compression spring that normally urges the housing away from the coupler and locking balls fitted in cutouts made in the locking member. When the spring is compressed, the locking balls move from the cutouts into an annular groove formed in the inner wall of the housing, thus allowing a limited sliding movement of the housing.

9 Claims, 3 Drawing Sheets

CONNECT/DISCONNECT CONNECTOR FOR COAXIAL CABLE

BACKGROUND OF THE INVENTION

This invention relates to couplings, and more particularly to a connector that can be used for connecting segments of coaxial cables together, or for connecting coaxial cables to televisions, video players, DVD players, and other types of electronic equipment.

Many types of electronic equipment are connected with coaxial cables. The coaxial cables conventionally have an electrically conductive core. The core must be electrically connected with a receptacle mounted on the body of the television, DVD player, and other similar equipment.

The core is encased in a non-conductive insulation. Before connecting the cable to a piece of an electronic equipment, the electrician has to crimp the end of the cable and attach a connector that has a threaded nut for engaging with the threaded receptacle on the electronic equipment to establish the electrical connection.

However, the electrician must have certain experience to perform the task of preparing a segment of cable for use. A lay person wishing to connect an outdoor antenna or cable to the indoor television usually does not possess these skills. Also, a lay person may not want to invest in expensive tools that allow cable crimping.

Even further, the connectors being usually on the back of a television set are not easily reachable. To unthread the connectors and remove the coaxial cable from the back of a television set may be awkward. This task may be particularly troublesome for people having limited movement in their hands. For this reason, various devices have been designed to make easier the connection between the coaxial cable and the television or cable box receptacle.

One such device is shown in U.S. Pat. No. 6,761,588 issued on Jul. 13, 2004 for "Coaxial cable quick connect/disconnect connector." The '588 patent discloses a connector having a hollow housing for attaching to a first electrical conductor and a coupler for attaching to a second electrical conductor. The housing and the coupler move to a limited distance in a sliding relation to each other. A locking member is fitted between the housing and the coupler to lock position of the housing in relation to the coupler and disengage the housing from the coupler when needed. The locking member has a compression spring that normally urges the housing away from the coupler and locking balls fitted in cutouts made in the locking member. When the spring is compressed, the locking balls move from the cutouts into an annular groove formed in the inner wall of the housing, thus allowing a limited sliding movement of the housing.

While the device of the '588 patent works satisfactory in many instances it was determined that some users, particularly those having reduced strength in their hands, experience some difficulty in engaging the connector with the receptacle on TV, cable box, and other electronic equipment using coaxial connectors. The present invention contemplates provision of an improved connect/disconnect connector for coaxial cable that requires less force for engagement and disengagement with the receptacle and is consequently easier to use.

U.S. Pat. No. 3,858,156 issued on Dec. 31, 1974 for "Universal Female Coaxial Connector". The '156 patent discloses a quick disconnect coupling that can be used for both push on and threaded connection. The device has a cylindrical outer conductor member with a flange and an insulating member inside. The outer conductor has two sections: the terminal threaded section, which extends one-third of the length of the connector member and a sleeve section with a resilient flap, which extends outwardly from the sleeve section. The free end of the sleeve has a diameter smaller than the adjacent threads, thereby utilizing the threads as a stop means when disengaging the connector.

SUMMARY OF THE INVENTION

It is therefore, an object of the present invention to provide a quick connect/disconnect coaxial cable connector.

It is another object of the present invention to provide a coupling that can be easily manipulated by people with restricted hand movement, while ensuring secure engagement of the coaxial cable with an electronic device.

It is a further object of the present invention to provide a coaxial cable connector that allows connecting segments of the cable without any specialized tools.

These and other objects of the present invention are achieved through a provision of a connector adapted to connect two electrical conductors, such as two or more segments of a coaxial cable. This allows quick and easy connect/disconnect engagement between two or more segments of coaxial cable. The connector has a hollow housing for attaching to a first electrical conductor and a coupler for attaching to a second electrical conductor. The housing and the coupler move to a limited distance in a sliding relation to each other. A locking member is fitted between the housing and the coupler to lock position of the housing in relation to the coupler and disengage the housing from the coupler when needed. The locking member has a compression spring that normally urges the housing away from the coupler and locking balls fitted in cutouts made in the locking member. When the spring is compressed, the locking balls move from the cutouts into an annular groove formed in the inner wall of the housing, thus allowing a limited sliding movement of the housing. To make it easier to move the connector between a locked and released position at least a portion of a cutout formed in the interior wall of the housing has an inclined aspect angled at between 50 to 60 degrees in relation to a longitudinal axis of the housing.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
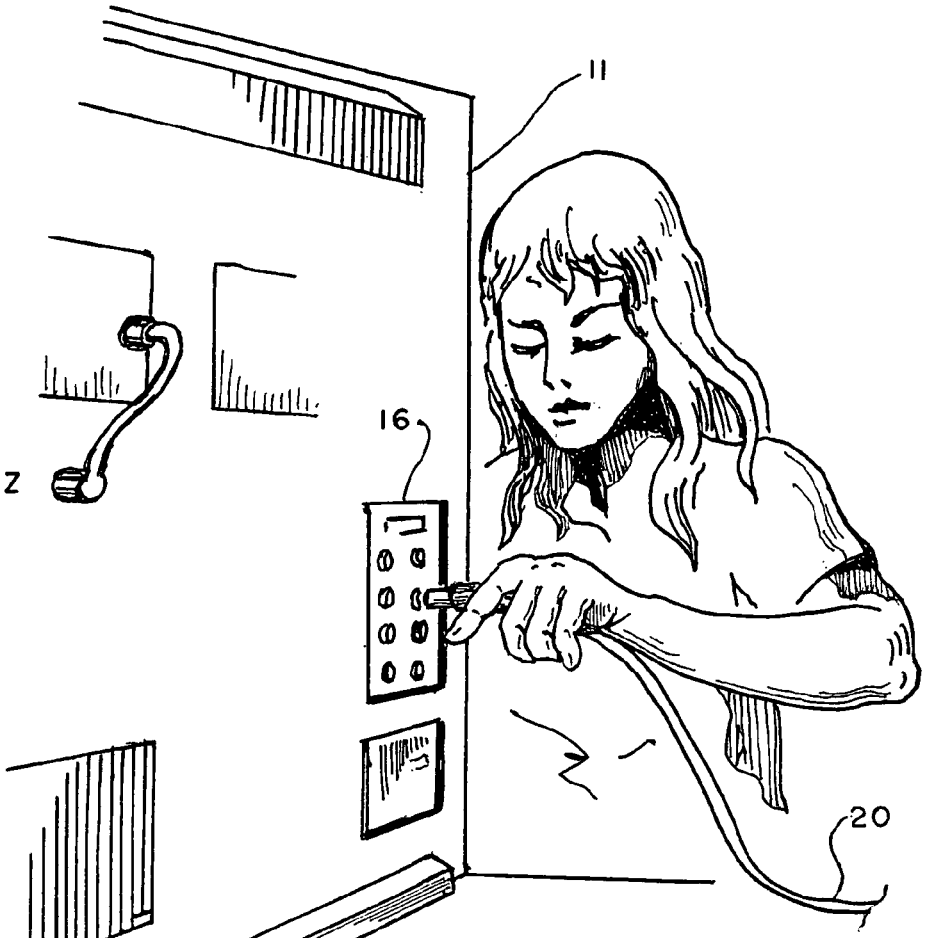
FIG. 1 illustrates a user engaging the connector of the present invention with a TV adaptor.

Turning now to the drawings in more detail, the locking connector assembly or connector of the present invention is generally designated by numeral 10. The assembly 10 comprises a first end 12 adapted for connecting to a receptacle 14 mounted on a television, DVD player or other similar electronic equipment secured on a mounting wall 16 of an electronic device 17.

The assembly 10 comprises a second externally threaded end 18, which is adapted for connection to a coaxial cable 20. Conventionally, the end of the coaxial cable 20 is provided with a coupler component 22, which allows the electrical conductor core 24 to extend outwardly. The coupler component 22 has inner threads (not shown), with which the threads 18 are configured to matchingly engage. When a nut 30 of the coupler component 22 is rotated the threads of the coupler component 22 are forced to engage with the threads of the threaded end 18 of the connector 10.

The assembly 10 comprises a receiver housing 32, a retainer means or ball retainer member 34, and a male adapter or coupler 36. The ball retainer member 34 is provided with a first cylindrical portion 40 formed with ball receiving cutouts or openings 42 therein, as will be explained in more detail hereinafter. The openings 42 are equidistantly spaced about the circumference of the first cylindrical portion 40. In one aspect of the invention, the openings 42 have a generally trapezoidal cross section, which allows the locking balls to firmly sit within an outer part of the openings 42 without falling through them.

Figure 4:
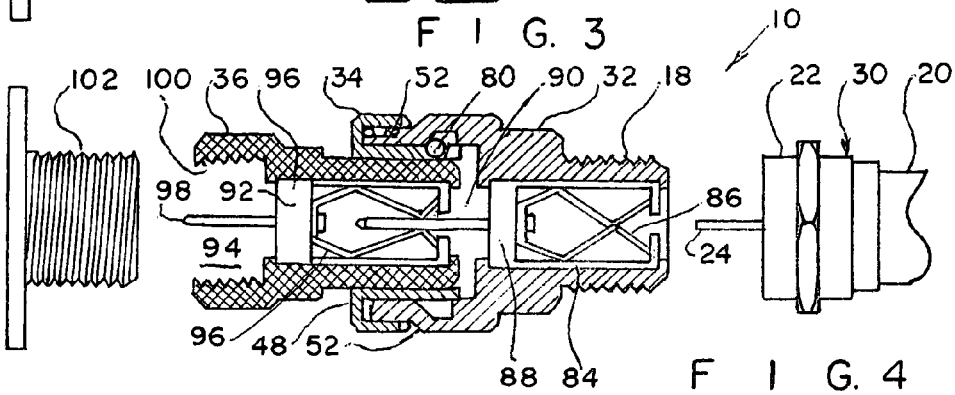
FIG. 4 is a cross-sectional view of the quick connect/disconnect coaxial cable connector of the present invention in a locked position.
Figure 5:
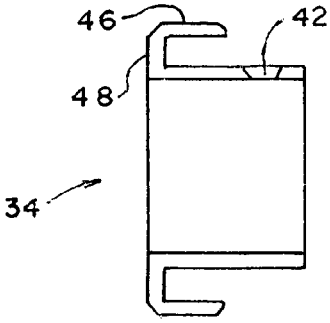
FIG. 5 is a detail view of the ball retainer member of the connector of the present invention.
Figure 6:
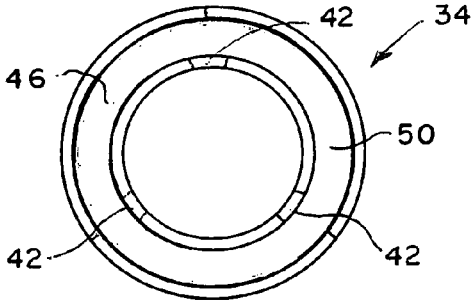
FIG. 6 is a cross sectional view of the ball retainer member shown in FIG. 4.

The first cylindrical portion 40 is sized and shaped to fit over at least a portion of a cylindrical portion 44 of the coupler 36. The ball retainer member 34 has an outwardly extending flange 46 that is unitary connected to the cylindrical portion 40 through an end bridge 48. An annular space 50 is formed between the flange 46 and the exterior of the cylindrical portion 40. A tension spring 52 is fitted in the annular space 50, as shown in FIG. 4. The spring 52 urges against an end 56 of the receiver housing 32 and against an outwardly extending annular shoulder 58 formed by the body of the receiver housing 32.

The end 56 of the receiver housing 32 is configured to slide along the exterior of the cylindrical portion 40 of the ball retainer member 34 fitting in the annular space 50 such that the annular flange 46 abuts against an inclined shoulder 62 of the receiver housing 32 when the retainer spring 52 is compressed and the connector is in a released position. In a locked position shown in FIG. 4, the annular flange 46 is slightly spaced from the inclined shoulder 62.

An inner wall 38 of the receiver housing 32 is provided with a central opening 64. The central opening 64 has a first elongated cylindrical cavity 66, connected with a plurality of different diameter cutouts formed in the interior of the housing 32. An inner shoulder 70 is formed across the central opening 64, decreasing the central opening 64 and separating the inner cavity 66 from the cutouts formed adjacent the end 56.

Figure 7:
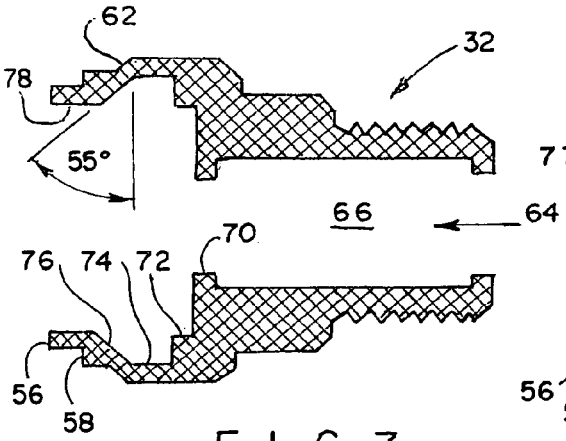
FIG. 7 is a cross sectional view of the receiver housing of the connector of the present invention.
Figure 8:
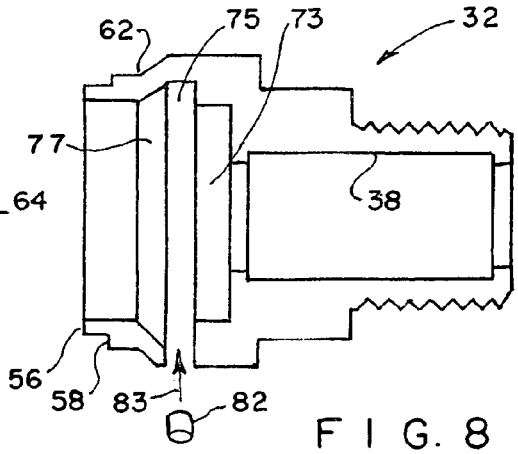
FIG. 8 is a cross sectional view illustrating the receiver housing with a plug.
Figure 10:
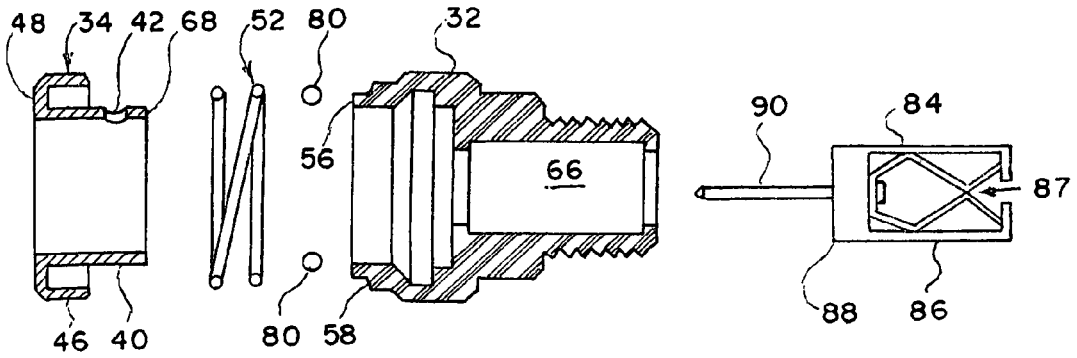
FIG. 10 is a detail exploded view showing the receiver housing and locking members used in the connector of the present invention.
Figure 9:
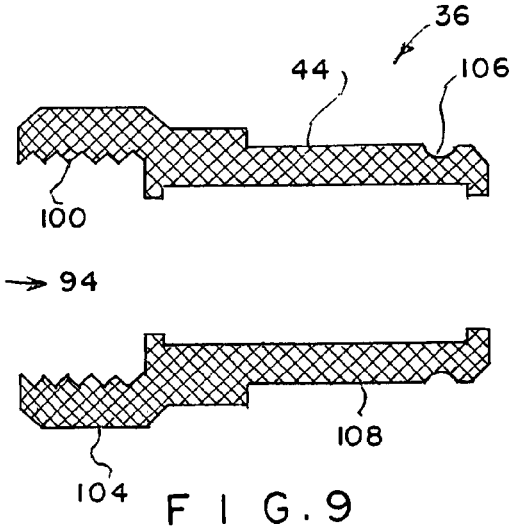
FIG. 9 is a cross-sectional view of the coupler of the connector of the present invention.

A first straight cutout 72 is formed on the inner wall 38 adjacent the inner shoulder 70 defining a first inner groove 73. A second straight cutout 74 is formed on the inner wall 38 adjacent the first straight cutout 72 defining a second inner groove 75. A third frustoconical cutout 76 is formed adjacent the second straight cutout 74 defining a third inner groove 77. A fourth straight cutout 78 defines the open end 56, as shown in FIGS. 7 and 8.

During tests, it was determined that the angle of the frustoconical cutout 76 should have a pre-determined angle in relation to a central longitudinal axis of the receiver housing 32. In one aspect of the invention the preferred angle is between 50° and 60°; in the preferred embodiment the angle of the angle of the inner wall frustoconical cutout 76 is 55°. As will be explained below, the locking balls slide along the inclined inner wall or cutout 76. To make it easier for the user to connect and disconnect the coaxial cable the angle of the inner inclined wall, along which the locking balls slide, should be preferably greater than 45°. The increased angle permits the locking balls 80 to be held more firmly in the receiver housing 32 and to produce the locking function smoothly. As can be seen in the drawings, the length of the inclined portion 76 of the inner 38 is somewhat greater than the length of the outer inclined shoulder 62.

Figure 11:
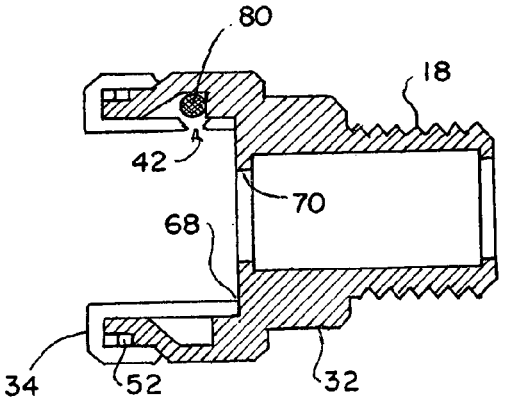
FIG. 11 is a detail view illustrating the locking ball in a disengaged position while the compression spring is compressed.
Figure 12:
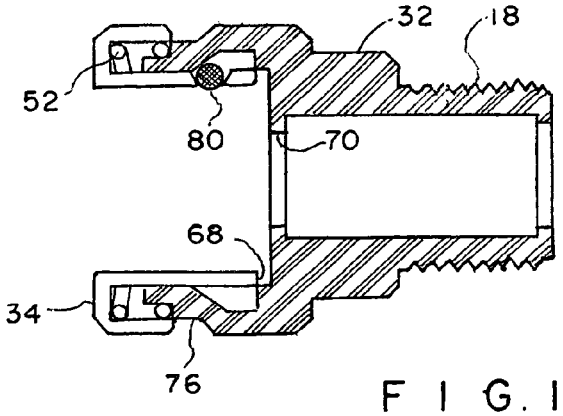
FIG. 12 is a detail view illustrating the locking ball in a locked position, while the compression spring is released.

An inner end 68 of the cylindrical portion 40 of the ball retainer member 34 contacts an inner shoulder 70 when the retainer spring 52 is compressed, as shown in FIG. 11. When the compression spring 52 is released the inner end 68 of the ball retainer member 34 moves away from the inner shoulder 70, as shown in FIG. 12.

In the preferred embodiment of this invention, three locking members or locking balls 80 are provided for fitting in the openings 42 and the cutout 75, 77. The locking balls 80 have greater diameter than the openings 42 and cannot pass through them. When the receiver housing 32 moves in relation to the ball retainer member 34 the locking balls 80 move between a disengaged position, as shown in FIG. 11 and a locked position, as shown in FIG. 12. A plug 82 is provided for engaging with an opening 83 formed in a side of the receiver housing 32. During assembly of the device 10, the locking balls 80 are positioned in the cutout 75 through the opening 83. The plug 82 is then inserted in the opening 83 to prevent the locking balls from escaping the receiver housing 32.

The connector assembly 10 further comprises a pair of coaxial cable inserts mounted in the central opening 64. A first insert, designated by numeral 84 in the drawings, is provided with a coaxial cable receiver 86 fitted into an insulated housing or enclosure 88. The cable receiver 86 is formed from an electrical conductive material, such as copper. The cable receiver 86 is enclosed in an insulating enclosure 88 formed from a non-conductive material. The tension fingers of the cable receiver 86 form a narrow passage 87 for receipt of the cable core 24. When the conducting core, or wire 24 is inserted into the receiver 86, the fingers press against the core 24 and establish an electrical connection with a signal conductor pin 90, which extends from an interior of the insulating enclosure 88 to an exterior thereof.

The conductor pin 90 has a first end which engages the fingers of the cable receiver 86 inside the enclosure 88 and a second end, which extends a distance from the enclosure 88. The signal conductor pin 90, similarly to the coaxial cable receiver 86 is formed from an electrical conductive material. The insert 84 is configured to fit into the cavity 66 of the receiver housing 32, as shown in FIG. 4.

A second insert 92 is fitted in the central opening 94 of the coupler 36. The second insert 92 is similar, in all respects, to the insert 84. It is provided with compression fingers 96 for receiving the signal conductor pin 90 of the first insert 84. An insulating enclosure 96 houses the fingers, or the pin receiving members 96 and an inner portion of a conductor pin 98.

Figure 2:
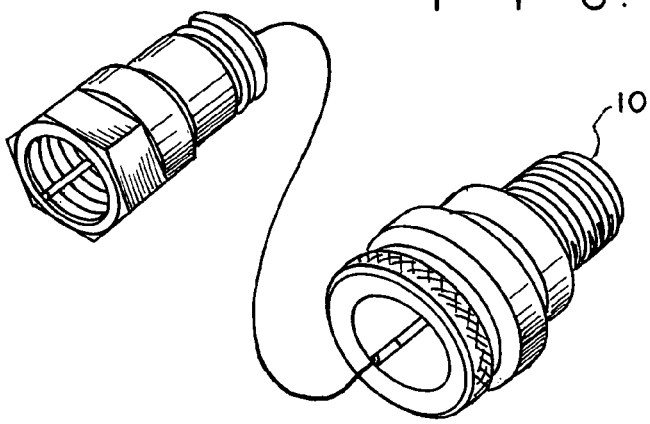
FIG. 2 is a perspective view of the quick connect/disconnect coaxial connector in accordance with the present invention as it will be engaged with a cable adaptor.
Figure 3:
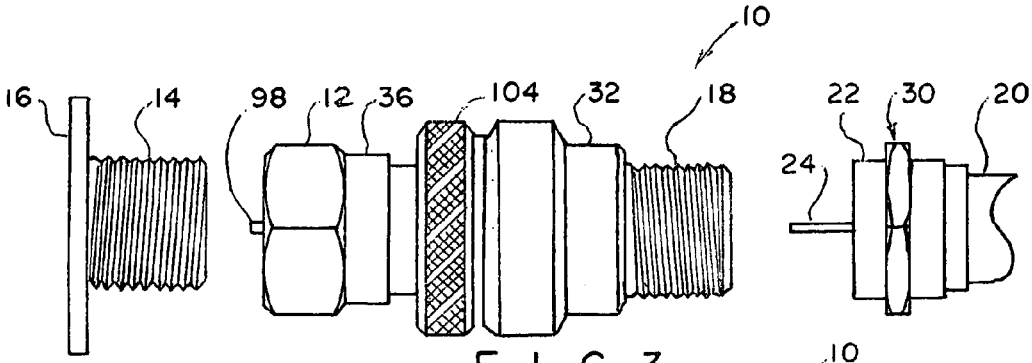
FIG. 3 is a side view of the quick connect/disconnect coaxial connector in accordance with the present invention.

As can be seen in FIGS. 2-4, the pin 98 has sufficient length to extend outwardly from an outer end of the coupling 36. The pin 98 transmits electrical signals from the core 24 of the coaxial cable 20 to the receptacle 14. The coupling member 36 is provided with inner threads 100 that are configured to mate with the threads 102 on the receptacle 14.

A portion of an exterior surface 104 of the connector 10 can be provided with friction-enhancing machined surface (FIG. 3) to allow engagement of the end 12 by the user's hands or by a wrench to facilitate rotation of the assembly 10 when engaging with the receptacle 14.

As can be seen in FIG. 4 the male adapter 36 is configured to frictionally fit within a central opening formed by the ball retainer member 34. An annular groove 106 is formed in an inner end 108 of the ball retainer member 36. In one aspect of the invention, the groove 106 is deep enough to accommodate at least one-fifth of the diameter of the balls 80 to ensure reliable locking of the balls 80.

When the connector 10 is in a locked position shown in FIGS. 4 and 12 the balls 80 fit in aligned openings 42 and groove 106, preventing disconnection of the coaxial cable and the receptacle 14 of electronic equipment, such as for instance a television set 11 shown in FIG. 1. When the user pushes the receiver housing 32 in the direction of the receptacle 14, the spring 52 becomes compressed, allowing the locking balls 74 to slide out from the openings 42 and groove 106 along the inclined surface 76 and move into the cutout 75 of the receiver housing 32. At the same time, the end 68 of the cylindrical portion 40 comes into contact with an inner shoulder 70 of the receiver housing 32, as shown in FIG. 11. The locking balls are in a disengaged position.

By pushing again on the housing 32 and causing it to move axially in the direction of the receptacle 14, the user can again move the locking balls 80 into a locked position, thereby affecting a quick connect/disconnect function of the assembly 10.

The assembly of the present invention is particularly beneficial for occasions where the screw on, similar to the coupler 22, is not available. For instance, this occasional arises when the cable was purchased without the compression fitting that would normally come into contact with the outer shield of the cable. The compression fittings are difficult to install and need special equipment. By avoiding the need for the compression fitting and by using the quick connect/disconnect assembly of the present invention the user would not need to be trained as an electrical technician.

The assembly of the present invention is made from conventional materials readily available on the market and can be inexpensively manufactured. The assembly is easily positioned over the connectable cable wires to provide a quick connect/disconnect function.

Many changes and modifications can be made in the design of the present invention without departing from the spirit thereof. We therefore pray that our rights to the present invention be limited only by the scope of the appended claims.

We claim:

1. A locking connector for electrically connecting segments of electrical conductors, comprising:

a housing for receiving a core of a first electrical conductor, said housing having a central opening and an enlarged diameter cutout formed in an inner wall of the housing, at least a portion of the cutout having an inclined aspect of between 50-60 degrees in relation to a central longitudinal axis of the housing;

a coupler for connecting to a second electrical conductor mounted in a substantially coaxial engagement with the housing;

a means mounted in the housing and in the coupler for establishing an electrical connection between the first and the second electrical conductors, to which said housing and said coupler are connected; and a locking means mounted between the housing and the coupler for locking the housing to the coupler and disengaging the housing from a locked engagement with the coupler by axially moving the housing toward the coupler, wherein said housing is provided with an aperture formed in a wall thereof, said aperture being configured to allow the locking means to pass therethrough.

2. The device of claim 1, said locking means comprising a retainer means for retaining locking members mounted between the housing and the coupler, a compression spring mounted between the retainer means and the housing, a plurality of locking members configured to engage the housing, the coupler and the retainer means, and a plug configured to tightly fit into the aperture after the locking members have been positioned in retainer means and prevent the locking members from disengaging from the housing.

3. A locking connector for electrically connecting segments of electrical conductors, comprising:

a housing for receiving a core of a first electrical conductor, said housing having a central opening and an enlarged diameter cutout formed in an inner wall of the housing, at least a portion of the cutout having an inclined aspect of between 50-60 degrees in relation to a central longitudinal axis of the housing;

a coupler for connecting to a second electrical conductor mounted in a substantially coaxial engagement with the housing;

a means mounted in the housing and in the coupler for establishing an electrical connection between the first and the second electrical conductors, to which said housing and said coupler are connected; and a locking means mounted between the housing and the coupler for locking the housing to the coupler and disengaging the housing from a locked engagement with the coupler by axially moving the housing toward the coupler, said locking means comprising a retainer member for retaining locking members mounted between the housing and the coupler, a compression spring mounted between the retainer member and the housing, a plurality of locking balls movable between a resting position away from the retainer member and into the enlarged diameter cutout formed in the housing when the compression spring is compressed to thereby allow the housing to slide into engagement with an inner wall of the retainer member, and wherein said housing is provided with an aperture formed in a wall thereof, said aperture being configured to allow the locking members to pass therethrough.

4. The device of claim 3, said retainer member having a cylindrical portion formed with a plurality of equidistantly spaced openings, each opening being configured to receive at least a portion of a locking member therein.

5. The device of claim 3, said coupler being provided with an annular groove on exterior surface thereof, said groove being configured to align with the openings formed in the retainer member and receive at least a portion of the locking members therein.

6. The device of claim 5, wherein said annular groove has a sufficient depth to accommodate at least one-fifth of diameter of each of the locking members.

7. The device of claim 3, further comprising a plug configured to tightly fit into the aperture after the locking members have been positioned in retainer member and prevent the locking members from disengaging from the housing.

8. The device of claim 3, wherein another portion of the cutout has a generally cylindrical configuration, and wherein the locking members are configured to move into said another portion while moving the locking members along the portion of the cutout having an inclined aspect when the locking members are in a released position.

9. The device of claim 3, said locking members comprising a plurality of locking balls.

* * * * *